US007955771B2

(12) United States Patent
Kikawa et al.

(10) Patent No.: US 7,955,771 B2
(45) Date of Patent: Jun. 7, 2011

(54) TONER FOR ELECTROSTATIC IMAGE DEVELOPMENT AND PROCESS FOR PREPARING THE SAME

(75) Inventors: Keiichi Kikawa, Osaka (JP); Yasuhiro Shibai, Yamatokoriyama (JP); Yoritaka Tsubaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 635 days.

(21) Appl. No.: 11/430,050

(22) Filed: May 9, 2006

(65) Prior Publication Data

US 2006/0257778 A1 Nov. 16, 2006

(30) Foreign Application Priority Data

May 13, 2005 (JP) ..... 2005-141481

(51) Int. Cl.
*G03G 9/08* (2006.01)

(52) U.S. Cl. ..... 430/108.1; 430/110.4

(58) Field of Classification Search ..... 430/108.1, 430/110.4

See application file for complete search history.

(56) References Cited

U.S. PATENT DOCUMENTS

| | | | | |
|---|---|---|---|---|
| 5,601,960 | A * | 2/1997 | Mahabadi et al. | 430/137.15 |
| 6,326,119 | B1 * | 12/2001 | Hollenbaugh et al. | 430/137.2 |
| 2002/0058193 | A1 * | 5/2002 | Tosaka et al. | 430/108.23 |
| 2002/0100392 | A1 * | 8/2002 | Sano et al. | 106/31.6 |
| 2003/0194628 | A1 * | 10/2003 | Yoshida et al. | 430/108.23 |
| 2004/0115549 | A1 * | 6/2004 | Ishii et al. | 430/108.23 |
| 2004/0229144 | A1 * | 11/2004 | Silence et al. | 430/108.4 |
| 2005/0100606 | A1 * | 5/2005 | Wang et al. | 424/470 |
| 2005/0106488 | A1 * | 5/2005 | Ida et al. | 430/108.23 |
| 2006/0063084 | A1 * | 3/2006 | Sweeney et al. | 430/108.7 |
| 2006/0154162 | A1 * | 7/2006 | Zhou et al. | 430/108.1 |
| 2006/0229382 | A1 * | 10/2006 | Schweikart et al. | 523/160 |
| 2007/0224531 | A1 * | 9/2007 | Ida et al. | 430/102 |
| 2007/0231729 | A1 * | 10/2007 | Ohno et al. | 430/108.24 |
| 2008/0044752 | A1 * | 2/2008 | Nakatani et al. | 430/108.23 |
| 2008/0050670 | A1 * | 2/2008 | Ayaki et al. | 430/110.4 |

FOREIGN PATENT DOCUMENTS

| | | | |
|---|---|---|---|
| JP | 4-330462 | | 11/1992 |
| JP | 6-250444 | | 9/1994 |
| JP | 7-181694 | A | 7/1995 |
| JP | 11-231572 | | 8/1999 |
| JP | 2000-338722 | | 12/2000 |
| JP | 2001-92165 | A | 4/2001 |
| JP | 2002-138216 | A | 5/2002 |
| JP | 2003-173048 | | 6/2003 |
| WO | 2004/094541 | * | 11/2004 |

* cited by examiner

*Primary Examiner* — Hoa V Le
(74) *Attorney, Agent, or Firm* — Nixon & Vanderhye P.C.

(57) ABSTRACT

A toner for electrostatic image development, comprising an organic pigment and a binding resin, and satisfying the formula (I):

$$1-R/A \leqq 0.014C \quad \text{(I)},$$

wherein A represents an entire area of a graph (x-axis: wavelength of a visible radiation region (380 to 780 nm), y-axis: transmittance (0 to 100%)) showing a spectral transmittance curve of a supernatant fluid, the supernatant fluid being obtained by subjecting the toner to an extraction process, the extraction process using a supercritical fluid; R represents an area determined by a Rectangular method on the basis of a spectral transmittance curve in the graph; and C represents a concentration (wt %) of the organic pigment in the toner, the organic pigment having a particle diameter of 1/10 to 1/2 (1/10 to 4/7 when the organic pigment is an organic yellow pigment) of a maximum absorption wavelength of the organic pigment, and the toner having a haze of 16 or less.

8 Claims, 1 Drawing Sheet

TONER FOR ELECTROSTATIC IMAGE DEVELOPMENT AND PROCESS FOR PREPARING THE SAME

CROSS-REFERENCE TO RELATED APPLICATION

This application is related to Japanese application No. 2005-141481 filed on May 13, 2005, whose priority is claimed and the disclosure of which is incorporated by reference in its entirety.

BACKGROUND OF THE INVENTION

1. Field of the Invention

The present invention relates to a toner for electrostatic image development and a process for preparing the same. More specifically, the present invention relates to a toner for electrostatic image development wherein properties such as chroma and transparency are improved and to a process for preparing the same.

2. Description of Related Art

Toners for use in electrophotography tend to have a reduced particle diameter in order to satisfy a recent demand for high definition images. Toners now being used are fine particle toners having in general an average particle diameter of about 5 to 15 μm. Typically, such fine particle toners are produced by the so-called crushing method comprising mechanically kneading a resin, a pigment and the like and then crushing the resultant kneaded product. The preparation of toners by the crushing method, however, is disadvantageous in that with reducing diameter of a toner produced, more complicated facility and procedure are required for the preparation of the toner and thus preparation costs of the toner increases. The preparation of toners by the crushing method is disadvantageous also in that toners prepared by the crushing method are unstable in chargeability because a pigment contained in the toner may be exposed at a particle surface. Mentioned as a toner preparation method that meets the demand for toner particle diameter reduction and that is more advantageous in productivity than the crushing method are polymerization methods such as a suspension polymerization method and an emulsion polymerization aggregation method. The polymerization methods, however, have a disadvantage that the resin is limited to an acrylic resin, and are inappropriate for preparation of color toners and for lower-temperature fixation and offset prevention of toners.

Toner preparation methods that have no limitation on the resin and that is more advantageous in productivity than the crushing method include an in-water drying method. The in-water drying method is advantageous for toner particle diameter reduction and, by the choice of pigment and resin, can also prevent the pigment from being exposed at a particle surface.

In recent years, there has been a demand for toners containing a pigment in an increased concentration, in view of a reduction of the amount of toners consumed. Such toners containing a pigment in an increased concentration suffer from transparency degradation and hue shift caused by an unreacted organic color pigment, which have not been greatly problematic with toners containing a pigment in a conventional concentration. Further, with increasing concentration of an organic pigment in a toner, toner particles come to stand closer to each other and become more liable to form aggregates. This makes it difficult to increase the density of a color of the toner solely by increasing the concentration of the organic pigment. Therefore, there is a limit to solutions of the above problems solely by the choice of organic pigment, resin and wax.

In general, pigments have merits of high light-resistance and high water resistance, while they have a demerit of lack of transparency.

Japanese Unexamined Patent Publication No. Hei 4(1992)-330462 proposes a color toner that has a combination of light-resistance, which is a feature of pigments, and clear hue and transparency, which are features of dyes. This toner, which contains a colorant obtained by reacting a reactive dye with a polymer having, on its side chain, an amino group and a hydroxyl group, can form an image having high transparency and high weather resistance. However, since the colorant is prepared in water using the dye and the highly hygroscopic polymer, the toner particles obtained are highly hygroscopic. This presents a problem that with increasing concentration of the colorant in the toner, the toner also becomes increasingly hygroscopic.

Japanese Unexamined Patent Publication No. Hei 11(1999)-231572 proposes a toner excellent in pigment dispersibility, transparency and color developability. This toner, which has high transparency, can be prepared by highly dispersing an organic or inorganic pigment in a binding resin with use of a synergist and a polymer dispersant. However, synergists resemble in skeleton to a pigment and have an aromatic ring and an auxochrome, and thus, in many cases, have a slight color. Further, as mentioned in Japanese Unexamined Patent Publication No. Hei 11(1999)-231572, synergists, which could possibly affect (decrease) the electric charge of a toner, cannot be used in a great amount. For the purpose of increasing the concentration of a pigment in a toner, the amount of a synergist to be added needs to be increased in accordance with the increase in the concentration of the pigment, and thus the effect of the synergist on the chargeability of the toner increases.

Unexamined Patent Publication No. 2000-338722 proposes a toner excellent in chroma and color developability. This toner has high transparency and can be prepared by highly dispersing a pigment in a binding resin with a high shearing force. However, since a slight amount of an unreacted pigment is present in the toner, the toner is not suitable for the demand for enhancing toner transparency, especially when the toner contains the pigment in an increased concentration.

Organic pigments for use in toners for electrostatic image development contain in their structure a chromophore, which mainly determines the absorption wavelength range of the pigments, and an auxochrome, which by itself does not produce a color but slightly changes the hue of the pigments. Unreacted products and by-products produced as impurities at manufacture of organic pigments have part of the structure of the organic pigments, which are a final product, but they lack part of the chromophore and part of the auxochrome of the final product. Further, organic pigments, which are designed to have a great molecular weight in order to acquire weather resistance, have many ring structures such as a benzene ring, and thus, are substantially an impurity. Many of organic pigments containing these ring structures have absorption wavelengths in the ultraviolet region. Impurities, which have part of the chromophore and part of the auxochrome, have absorption wavelengths shifted in the visible radiation region, and thus, in many cases, their maximum absorption wavelength differs from that of organic pigments, which are a final product. In other words, when a toner contains impurities, the absorption wavelength range of an organic pigment as a whole contained in the toner is widened to darken the toner and reduce its transparency. This is not a significant problem with conventional toners containing an organic pigment typically in a concentration of about 5 wt %, but has a serious effect when the concentration of an organic pigment exceeds about 8 wt % in order for the amount of a toner consumed to be reduced.

In order to solve the above prior art problem and meet the demand for an improvement in image quality and a reduction in the amount of a toner consumed, the present invention provides a toner for electrostatic image development, which while containing an organic pigment in an increased concentration, has a high chroma and a high transparency, and a process for preparing the same.

The present inventors have found, as a result of eager study for solution of the above problem, that a toner for electrostatic image development which, while containing a pigment in an increased concentration, is excellent in chroma and transparency, can be obtained when the toner satisfies particular conditions on the concentration of the organic pigment contained therein and on the dispersion particle diameter of the pigment (particle diameter of the pigment when the pigment is present in the toner).

SUMMARY OF THE INVENTION

In one aspect of the present invention, there is provided toner for electrostatic image development, comprising an organic pigment and a binding resin, and satisfying the formula (I): $1-R/A \leqq 0.014C$ (I), wherein A represents an entire area of a graph (x-axis: wavelength of a visible radiation region (380 to 780 nm), y-axis: transmittance (0 to 100%)) showing a spectral transmittance curve of a supernatant fluid, the supernatant fluid being obtained by subjecting the toner to an extraction process, the extraction process using a supercritical fluid; R represents an area determined by a Rectangular method on the basis of a spectral transmittance curve in the graph; and C represents a concentration (wt %) of the organic pigment in the toner, the organic pigment having a particle diameter of 1/10 to 1/2 (1/10 to 4/7 when the organic pigment is an organic yellow pigment) of a maximum absorption wavelength of the organic pigment, and the toner having a haze of 16 or less.

In another aspect of the present invention, there is provided a process for preparing a toner for electrostatic image development, comprising: a step (a) of melting and kneading a mixture of at least an organic pigment and a binding resin to prepare a kneaded product wherein the organic pigment is dispersed in the binding resin; and a step (b) of pulverizing the kneaded product and classifying the resultant particles to prepare the toner having a controlled particle size distribution, wherein the mixture in the step (a) contains the organic pigment in an amount of 8 to 20 wt % of the mixture, and the step (b) is carried out so that the organic pigment dispersing in the toner has a particle diameter of 1/10 to 1/2 (when the organic pigment is an organic yellow pigment, 1/10 to 4/7) of a maximum absorption wavelength of the organic pigment, and that the toner has a haze of 16 or less.

The present invention can provide a toner for electrostatic image development which meets the demands for an improvement in image quality and for a reduction in the amount of a toner consumed and which, while containing an organic pigment in an increased concentration, has high chroma and high transparency, and a process for preparing the same. Further, the toner of the present invention can also solve the problems existing with the prior art toners: the increase in hygroscopicity (Japanese Unexamined Patent Publication No. Hei 4(1992)-330462); the decrease in electric charge of the toner due to the increase in the amount of the synergist (Japanese Unexamined Patent Publication No. Hei 11(1999)-231572); and the lack of sufficient toner transparency, all the problems being caused when the concentration of the colorant in each toner is increased.

DESCRIPTION OF THE PREFERRED EXAMPLES

The present invention provides a toner for electrostatic image development, comprising an organic pigment and a binding resin, and satisfying the formula (I): $1-R/A \leqq 0.014C$ (I), wherein A represents an entire area of a graph (x-axis: wavelength of a visible radiation region (380 to 780 nm), y-axis: transmittance (0 to 100%)) showing a spectral transmittance curve of a supernatant fluid, the supernatant fluid being obtained by subjecting the toner to an extraction process, the extraction process using a supercritical fluid; R represents an area determined by a Rectangular method on the basis of a spectral transmittance curve in the graph; and C represents a concentration (wt %) of the organic pigment in the toner, the organic pigment having a particle diameter of 1/10 to 1/2 (1/10 to 4/7 when the organic pigment is an organic yellow pigment) of a maximum absorption wavelength of the organic pigment, and the toner having a haze of 16 or less.

Figure 1:
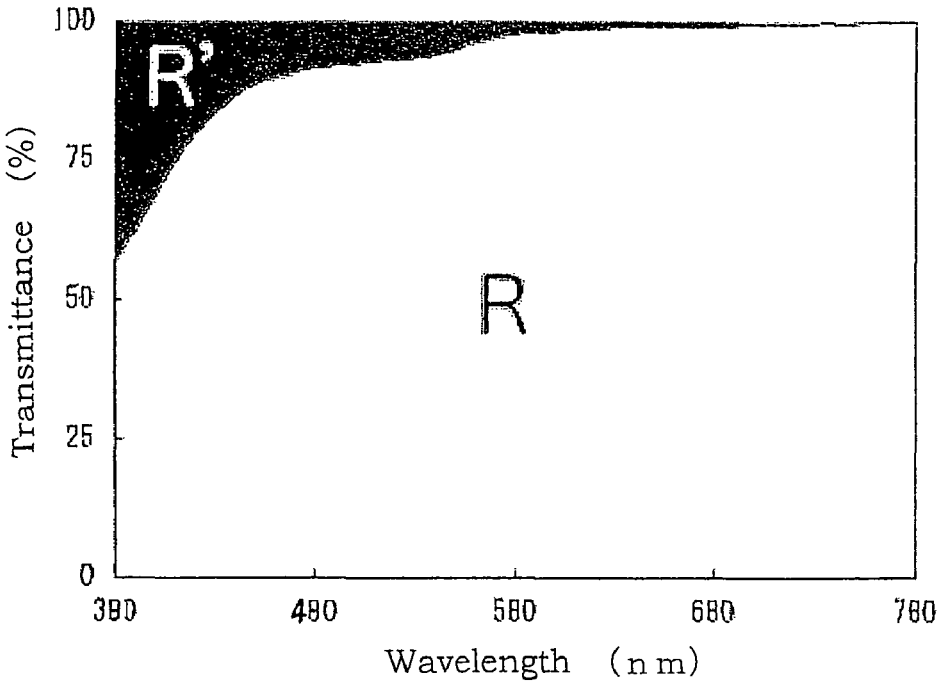
FIG. 1 is a graph showing a spectral transmittance curve of a supernatant fluid obtained by subjecting a toner for electrostatic image development of the present invention to an extraction process.

In the present specification, the graph showing a spectral transmittance curve refers to a graph, showing transmittance (0 to 100%) vs. visible radiation region (380 to 780 nm), as that illustrated in FIG. 1. The entire area of the graph is A in the above formula (I). The spectral transmittance curve in the graph serves as a boundary between two areas. One of the areas is determined by a Rectangular method (integration). This area is R in the formula (I). The other area is determined by $A-R=R'$ (formula 1). As the value $R \propto$ nears 0, the transmittance of the supernatant fluid nears 0 in the entire visible radiation region, which indicates that the amount of impurities in the organic pigment becomes smaller. In other words, as the ratio of R' to A, i.e., R'/A (formula 2) wherein A represents the entire area of the graph falls, the amount of the impurities in the organic pigment in the toner becomes smaller. Therefore, the smaller the ratio R'/A (formula 2) is, the more preferable.

As mentioned above, darkening of a toner and reduction of its transparency is linked to the concentration of an organic pigment in the toner. When the relationship between the formula obtained by substituting the formula 1 into formula 2 and the product obtained by multiplying the concentration C of the organic pigment in the toner by 0.014 falls within the range defined by the formula (I): $1-R/A \leqq 0.014C$, the spectral transmittance curve inherent in the organic pigment can accurately be reproduced in the visible radiation region and thus the toner has improved chroma and transmittance. In the formula (I), the value 0.014 is a coefficient, by which the concentration C of the organic pigment is multiplied, for the judgment on whether the toner is favorable in terms of tinting strength, chroma and transmittance.

It is not preferable for the toner to fail to satisfy the formula (I) because, in such a case, the toner tends to have degraded chroma and transmittance.

In general, organic pigments exhibit transparency when their dispersion particle diameter is ½ or less than ½ of their maximum absorption wavelength. Organic yellow pigments, however, have relatively short absorption wavelengths (about 400 nm), and thus, it is technically difficult to make control so that the dispersion particle diameter of the yellow pigments is ½ or less than ½ of the maximum absorption wavelength thereof. For this reason, the organic yellow pigments are assumed to exhibit transparency when their dispersion particle diameter is 1/10 to 4/7 of their maximum absorption wavelength. Toner transparency contributes to an improvement in image quality, especially when toners of a plurality of colors are used to overlay colors. In contrast, when the dispersion particle diameter of an organic pigment is less than 1/10 of the maximum absorption wavelength thereof, the organic pigment has absorption wavelengths in the Rayleigh scattering region, so that there is substantially no scattering of light, and color developability of the organic pigment is poor. When the dispersion particle diameter of an organic pigment exceeds ½ (in the case of an organic yellow pigments, 4/7) of the maximum absorption wavelength thereof, toner transparency is degraded. When the dispersion particle diameter of an organic pigment is about 1/10 to ½ of the maximum absorption wavelength thereof, therefore, the organic pigment can develop a color the most preferably and also provides favorable transparency. For this reason, even if toners satisfy the above formula (I): $1-R/A \leqq 0.014C$, they cannot fully exhibit favorable transparency and color developability unless the dispersion particle diameter of a pigment is optimized. When the condition that the dispersion particle diameter of an organic pigment should be 1/10 to ½ (in the case of an organic yellow pigment, 1/10 to 4/7) of the maximum absorption wavelength thereof is further satisfied, color developability inherent in organic pigments can be made full use of and favorable transparency can be ensured.

In the present invention, the particle diameter of an organic pigment when the organic pigment is present in a toner (dispersion particle diameter of an organic pigment) refers to a value obtained by cutting a toner particle by a microtome to obtain a sample in the form of a flake; capturing a photograph of the sample under a magnification of 10000 times by means of a transmission electron microscope (TEM); measuring a major diameter and a minor diameter of a pigment portion of the sample by means of an image analyzer (OMNICON 3500: manufactured by SHIMADZU CORPORATION); determining an average value of the major diameter and minor diameter; and averaging average values of 1000 samples obtained in the above manner. Organic pigments used in Examples and Comparative Examples have maximum absorption wavelengths as follows: about 414 nm (organic yellow pigments); about 538 nm (organic magenta pigments); and about 713 nm (organic cyan pigments).

Preferably, the toner of present invention has, in addition to containing the organic pigment having the above-mentioned particle diameter in the above-mentioned concentration, a haze of 16 or less, more preferably 15 or less. Even a toner containing an extrapolating agent preferably has a haze of 16 or less. A toner haze exceeding 16 is not preferable because in such a case, transparency of the toner is unsatisfactory.

As described above, the toner for electrostatic image development of the present invention satisfies all the conditions: the formula (I): $1-R/A \leqq 0.014C$ (I); that the organic pigment should have a dispersion particle diameter of 1/10 to ½ (when the organic pigment is an organic yellow pigment, 1/10 to 4/7) of its maximum absorption wavelength; and that the toner should have a haze of 16 or less. More specifically, the concentration C of the pigment in the toner is 8 to 20 wt %, preferably 8 to 16 wt %, more preferably 8 to 12 wt %. The dispersion particle diameter of the organic pigment is 200 to 330 nm, preferably 208 to 325 nm, more preferably 208 to 299 nm. The haze is 16 or less, more preferably 15 or less.

Because the supercritical fluid has a diffusion coefficient as high as that of gas and a viscosity as low as that of gas, it rapidly facilitates a concentration balance. Also, the supercritical fluid has a high degree of solubility because it has the same degree of density as that of liquid. Accordingly, subjecting a toner containing an organic pigment to an extraction process that uses the supercritical fluid (supercritical fluid extraction) and/or a purification process that uses the supercritical fluid is advantageous in terms of efficiency in extraction and/or purification. Examples of supercritical fluids include carbon dioxide, ethylene, propane, toluene and other organic gases. Among these, preferable is carbon dioxide in terms of ease of handling because it reaches a state of criticality under moderate conditions of 31° C. and 7.38 MPa, and because it is in gaseous form at atmospheric temperatures and pressures. Here, water is not preferable because it reaches a state of criticality under relatively extreme conditions of 374.1° C. and 22.12 MPa (a high temperature and a high pressure) and because there is a risk that the water in a state of supercriticality may decompose the binding resin and the like. Water, however is suitable for use as an extracting cosolvent to be mixed with a supercritical fluid such as carbon dioxide. Such extracting cosolvents other than water include lower alcohols (e.g., methanol, ethanol and the like).

In the present invention, the organic pigment may be a commercially available unpurified pigment, but preferably it is a purified pigment, which has undergone a purification process that uses a supercritical fluid and thus contains no impurities. In other words, by subjecting an organic pigment to purification to remove impurities such as unreacted products and by-products (especially conductive impurities) from the organic pigment before allowing a toner to contain the organic pigment in an increased amount, the toner can more easily satisfy the formula (I) and its electric charge can be raised.

In the below, the constituents of the toner of the present invention will be explained.

Binding Resin

Typical examples of binding resins for use in the present invention include a vinyl type resin, a polyester type resin, a polyurethane type resin and a polyether polyol type resin. These may be used alone, or in a combination of two or more, or in a combination of two or more of modified resins obtained from these.

Among the above, preferable is the polyester type resin (copolymer) because it permits low temperature fixation by taking advantage of sharp meltability, because it is excellent in transparency and secondary color reproducibility, and because it is suitable for use in a color toner. The amount of acid radical in the polyester type resin if the polyester type resin is an anionic one and the amount of base in the polyester type resin if the polyester type resin is an cationic one is preferably 20 to 500 mg equivalent weight/100 g of the resin solid content, most preferably 50 to 250 mg equivalent weight/100 g of the resin solid content. The polyester type resin has preferably a glass transition temperature (Tg) of 50 to 90° C., more preferably 50 to 70° C., in terms of the thermal fixation property and storage stability property of the toner.

The polyester type resin has a number average molecular weight (Mn) of about 3000 to 100000 and preferably 3200 to 6000. When it has a number average molecular weight of less than 3000, granulation is difficult. When it has a number average molecular weight of more than 100000, the polyester type resin has too high a viscosity at the time of granulation, which reduces efficiency in the granulation, and there is a high possibility that the polyester type resin may have a three-dimensional structure or may be cross-linked, which reduces toner transparency.

Pigment

The following are examples of the organic pigments for use in the toner for electrostatic image development of the present invention:

Examples of the organic black pigments include aniline black.

Examples of the organic yellow pigments include naphthol yellow S, hansa yellow G, hansa yellow 10G, benzidine yellow G, benzidine yellow GR, quinoline yellow lake, permanent yellow NCG and tartrazine lake.

Examples of the organic orange pigments include permanent orange GTR, pyrazolone orange, vulcan orange, indanthrene brilliant orange RK, benzidine orange G and indanthrene brilliant orange GK.

Examples of the organic red pigments include permanent red 4R, lithol red, pyrazolone red, watching red, calcium salt, lake red C, lake red D, brilliant carmine 6B, eosine lakes rhodamine lake B, alizarin lake, amaranth, brilliant carmine 3B, quinacridon red and naphthol red.

Examples of the organic purple pigments include fast violet B, methyl violet lake and quinacridon.

Examples of the organic blue pigments include victoria blue lake, phthalocyanine blue, metal-free phthalocyanine blue, phthalocyanine blue portion chloride, fast sky blue, indanthrene blue BC and anthraquinon.

Examples of the organic green pigments include pigment green B, mica light green lake, final yellow green G and phthalocyanine green.

The pigment of the present invention is composed mainly of an organic pigment. However, an inorganic pigment may be added to such an extent that does not damage effects of the present invention. Examples of such inorganic pigments include inorganic black pigments such as carbon black, copper oxide, manganese dioxide, activated carbon, nonmagnetic ferrite, magnetic ferrite, magnetite, inorganic yellow pigments such as chrome yellow, zinc yellow, cadmium yellow, yellow iron oxide and nickel titanium yellow, inorganic orange pigments such as red chrome yellow and molybdenum orange, inorganic red pigments such as colcothar, cadmium red, red lead, mercury sulfide and cadmium, inorganic purple pigments such as manganese violet, inorganic blue pigments such as Berlin blue, cobalt blue, alkali blue lake, inorganic green pigments such as chrome green and chromium oxide, and inorganic white pigments such as zinc white, titanium oxide, antimony white and zinc sulfide.

If used in a negatively charged toner, the pigment itself is preferably a negatively charged pigment such as copper phthalocyanine, perylene, quinacridon or azo-pigment.

Constituents of Toner Other than Above

In addition to the binding resin and the organic pigment disclosed above, the toner for electrostatic image development of the present invention may comprise upon necessity a magnetic powder, a releasing agent, a charge controlling agent and an anti-offset agent for example.

Examples of the magnetic powders include magnetite, y-hematite, and various kinds of ferrite.

Examples of the releasing agents used for improving the fixation property of the toner include various kinds of waxes, especially polyolefin type waxes such as low molecular weight polypropylene and polyethylene and oxidized polypropylene and polyethylene.

Examples of the charge controlling agents include dyes comprising a complex of a quaternary ammonium salt compound, of a nigrosine type compound, of aluminum, of iron, or of chromium, a triphenylmethane type organic pigment, a metal complex of salicylic acid and a calix arene type charge controlling agent.

The anti-offset agent used for improving the fixation property of the toner is not particularly limited as long as it is commonly used as a toner material, and as an example of such anti-offset agent the following may be mentioned: petroleum waxes such as paraffin wax, oxidized paraffin wax, microcrystalline wax, mineral waxes such as montan wax, animal and plant waxes such as beeswax and carnauba wax, and synthesized waxes such as polyolefin wax (e.g., polyethylene and polypropylene), oxidized polyolefin wax and Fischer-Tropsch wax. These anti-offset agents (mold release agents) may be used singly or in a combination of two or more.

(Process for Preparing Toner for Electrostatic Image Development)

The present invention provides a process for preparing a toner for electrostatic image development, comprising: a step (a) of melting and kneading a mixture of at least an organic pigment and a binding resin to prepare a kneaded product wherein the organic pigment is dispersed in the binding resin; and a step (b) of pulverizing the kneaded product and classifying the resultant particles to prepare the toner having a controlled particle size distribution, wherein the mixture in the step (a) contains the organic pigment in an amount of 8 to 20 wt %, and the step (b) is carried out so that the organic pigment in the toner has a very small particle diameter of 1/10 to 1/2 (when the organic pigment is an organic yellow pigment, 1/10 to 4/7) of a maximum absorption wavelength of the organic pigment, and that the toner has a haze of 16 or less. The above process of the present invention permits preparation of toners that satisfy the above formula (I).

In the melting and kneading step, preferably, the mixture is melted and kneaded at a temperature twice or less than twice as high as a glass transition temperature of the binding resin, since, in such a case, the organic pigment, an additive and the like can be dispersed in the resin with high efficiency so that significant decrease of a viscosity of the resin at the melting can be avoided. Further, if this step is carried out with a shearing force applied to the mixture by a kneading roll for heating and a kneading roll for cooling opposite in rotational direction to the kneading roll for heating, a high shearing force can be applied to the mixture. As a result, the organic pigment can have a very small dispersion particle diameter of 1/10 to 1/2 (about 200 to 330 nm for example) (when the organic pigment is an organic yellow pigment, 1/10 to 4/7) of a maximum absorption wavelength of the organic pigment, and can be highly dispersed in the toner. Further, the toner can exhibit tinting strength improved because of the increase in the concentration of the pigment in the toner.

The melting and kneading step may be replaced with the so-called polymerization method, which is a method of preparing particles in an aqueous solution or in a solvent, such as a suspension method, an emulsion aggregation method or an in-water drying method. However, the melting and kneading step is preferable because this step permits the pigment, the wax, the charge controlling agent and the like to be highly dispersed in the resin and because it does not permit toner particles to contain a dispersant and water, which would affect the electric charge of the toner.

The process for preparing toner for electrostatic image development of the present invention may further comprise, prior to the step (a), the step of purifying the organic pigment so that impurities can be removed from the organic pigment. It is preferable to use a purified organic pigment because, in such a case, as mentioned above, a toner containing an organic pigment in an increased amount can more easily satisfy the above formula (I) and its electric charge can be raised.

In the step of purifying the organic pigment, it is preferable to remove, by using an impurities-extracting fluid in a state of supercriticality (supercritical fluid), unreacted products and/or by-products, that are impurities generated at manufacture of the organic pigment and left in the organic pigment.

In the below, the steps of the process of the present invention will be described in detail.

Step of Purifying Organic Pigment

Figure 2:
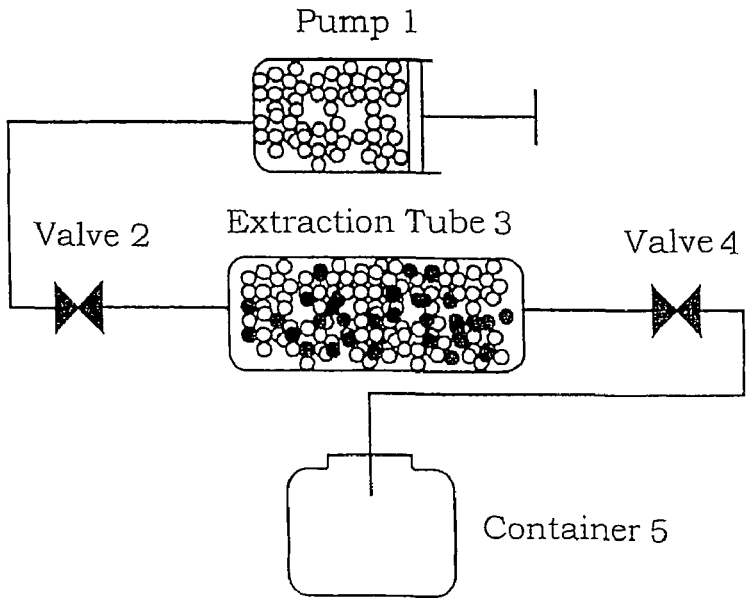
FIG. 2 is a schematic view showing a construction of a purifying device for use in preparation of the toner for electrostatic image development of the present invention.

The step of purifying the organic pigment may be carried out by using, for example, a purifying device shown in FIG. 2. First, a pump 1 is filled with the impurities-extracting fluid (e.g, a carbon dioxide gas: indicated by the symbol ○ in FIG. 2), and the organic pigment (indicated by the symbol ● in FIG. 2) is supplied into an extraction tube 3 and a hydrophilic extracting cosolvent (water or lower alcohol). Next, by opening a valve 2, the impurities-extracting fluid, which has been compressed to a high pressure and brought into a state of supercriticality, is allowed to fill the extraction tube 3. After the organic pigment is subjected to extraction at a predetermined temperature for a predetermined period, a valve 4 is opened to reduce the pressure in the extraction tube 3, and the contents of the extraction tube 3*l* including the organic pigment is removed into a container 5. Subsequently, the organic pigment is separated from the contents, washed and dried. Thus, a purified organic pigment free from impurities such as unreacted products and by-products can be obtained.

In the present invention, the step of purifying the organic pigment is not necessarily required, but if a purified organic pigment having undergone this step is used in later steps, a toner excellent in properties can easily be prepared.

Melting and Kneading Step

In this step, first, (I) (i) a combination of binding resin and a purified or unpurified organic pigment or (ii) a combination of a binding resin and a master batch composition wherein a purified or unpurified organic pigment is preliminarily dispersed in a binding resin and, upon necessity, (II) additive(s) (a charge controlling agent, a wax and/or a dispersant) are dry-mixed by a mixer, and then the resultant mixture is melt and kneaded so that the pigment is dispersed uniformly in the binder resin.

Usable as a mixer are Henschel type mixers such as a Henschel mixer (manufactured by Mitsui Mining Company Limited), a super mixer (manufactured by KAWATA MFG. Co., Ltd.) and a mechanomill (manufactured by Okada Seiko, Co., Ltd.) and apparatuses such as an angmill (manufactured by Hosokawa Micron KK), a hybridization system (manufactured by Nara Machinery Co., Ltd.) and a cosmo system (manufactured by Kawasaki Heavy Industries, Ltd.). Usable as a kneader are single- or double-screw extruders such as a TEM-100B (manufactured by Toshiba Machine) and a PCM-65/87 (manufactured by IKEGAI) and open roll type kneaders such as a kneadex (manufactured by Mitsui Mining Company Limited). Especially in the melting and kneading step, in order to avoid significant decrease of a viscosity of the resin at the melting and thus improve the efficiency of dispersion of the additive(s), the kneading is desirably carried out with a high shearing force at a low temperature, especially by an open roll type kneader.

Pulverizing and Classifying Step

In this step, the kneaded product is pulverized by, for example, either a jet mill of collision type that utilizes a jet stream or a mechanical mill, and the resultant particles are classified by wind power or the like to prepare a toner having a controlled particle size distribution.

The toner having undergone the pulverizing and classifying step has preferably a volume-average particle diameter of 3 to 10 μm and a sharp particle-size distribution curve, but the particle diameter of the toner is not limited to the above. More specifically, desirably, the toner has a controlled particle size distribution such that, when the toner has a volume-average particle diameter D50 (diameter of 50% by number of the toner particles), the amount of particles having a diameter of 0.5xD50 or less constitutes 20% by volume or less and the amount of particles having a diameter of 2×D50 or more constitutes 2% by volume or less of the toner.

After the pulverizing and classifying step, extrapolating agent(s) such as a fluidizing agent, a charge controlling agent and/or a surface resistance controlling agent may be added to the toner upon necessity. Examples of inorganic fine powders for use as the extrapolating agent include a silica fine powder, a titanium oxide fine powder and an alumina fine powder. For the purpose of hydrophobization and charge control, the inorganic fine powder may be treated with, upon necessity, an agent such as a silicone varnish, a modified silicone varnish, a silicone oil, a modified silicone oil, a silane coupling agent, a silane coupling agent having a functional group, or another organosilicon compound. These agents may be used in a combination of two or more.

Preferable examples of other additive for use in the present invention include a lubricant such as Teflon®, zinc stearate, polyvinylidene fluoride and silicone oil particle (containing about 40% of silica). Also, a small amount of white fine particles opposite in polarity to the toner particles may be used as a development improving agent.

The present invention will now be described in detail by way of examples. However, it should be understood that the present invention is not limited to these examples.

EXAMPLES

Preparation of Purified Organic Pigments

Purified organic pigments to be used in some of Examples and some of Comparative Examples were prepared in the following manners.

[Purified Organic Pigment scY]

A commercially available organic yellow pigment (FAST YELLOW FGOK [manufactured by Sanyo Color Works, Ltd.]: C.I. pigment yellow 74) was purified under the following conditions to prepare a purified organic pigment scY.

Object to be purified: organic yellow pigment (FAST YELLOW FGOK [manufactured by Sanyo Color Works, Ltd.]) 50 g Extraction solvent (impurities-extracting fluid): carbon dioxide 130 g Hydrophilic cosolvent: methanol 20 g Extraction tube capacity: 200 ml Extraction pressure: 200 atm Extraction temperature: 50° C.

Extraction time: 30 min.

[Purified Organic Pigment scM]

A commercially available organic magenta pigment (Toner Magenta E-02 [manufactured by Clariant (Japan) KK]: C.I. pigment red 122) was purified under the following conditions to prepare a purified organic pigment scM.

Object to be purified: organic magenta pigment (Toner Magenta E-02 [manufactured by Clariant (Japan) KK]) 50 g
Extraction solvent: carbon dioxide 130 g
Hydrophilic cosolvent: methanol 20 g
Extraction tube capacity: 200 ml
Extraction pressure: 200 atm
Extraction temperature: 50° C.
Extraction time: 30 min.

[Purified Organic Pigment scC]

A commercially available organic cyan pigment (Hostaperm Blue B2G [manufactured by Clariant (Japan) KK]: C.I. pigment blue 15:3) was purified under the following conditions to prepare a purified organic pigment scC.

Object to be purified: organic cyan pigment (Hostaperm Blue B2G [manufactured by Clariant (Japan) KK]) 50 g
Extraction solvent: carbon dioxide 130 g
Hydrophilic cosolvent: methanol 20 g
Extraction tube capacity: 200 ml
Extraction pressure: 250 atm
Extraction temperature: 60° C.
Extraction time: 30 min.

Example 1

A preliminarily kneaded product (master batch composition) in which 40 wt % of a commercially available unpurified organic yellow pigment (FAST YELLOW FGOK [manufactured by Sanyo Color Works, Ltd.]: C.I. pigment blue 74) was dispersed in advance in a binding resin having a glass transition temperature Tg=60° C. and a ½ flow softening temperature Tm=110° C. and a charge controlling agent were charged into a Henschel mixer and mixed for ten minutes to obtain a mixture as a raw material. The binding resin, the preliminarily kneaded product and the controlling agent are used in the following amounts for preparation of a toner containing the organic pigment in a concentration of C wt %.

Binding resin (polyester resin): (98-Y) parts by weight
Preliminarily kneaded product: Y parts by weight
Charge controlling agent (a metal alkyl salicylate): 2 parts by weight C/100=0.4×Y/100, wherein C=8 in Example 1, C being the concentration of the organic pigment in the toner.

Subsequently, the mixture was melted and kneaded by means of a kneadex MOS 140-800 (manufactured by MITSUI MINING COMPANY, LIMITED) so that the organic pigment was dispersed in the binding resin. Kneading conditions in Example 1 were as follows: a supply-side temperature of a front roll was 60° C.; a discharge-side temperature of the front roll was 30° C.; a supply-side temperature of a back roll was 20° C.; a supply-side temperature of the back roll was 20° C.; a rotary speed of the front roll was 75 rpm; a rotary speed of the back roll was 60 rpm; and a mixture supply speed was 10 kg/h. In Example 1 and Examples 2 to 12, and Comparative Examples 1 and 3 to 6, the temperature of the mixture measured at any time in the above melting and kneading step (kneading temperature) by an infrared noncontact thermometer was 120° C. or less.

The kneaded product thus obtained was cooled, roughly crushed and then, by means of a jet mill, pulverized. Then, the resultant particles were classified by wind power while being sized with a Coulter multisizer II to prepare particles having a controlled particle size distribution such that, when a volume-average particle diameter is D50, the amount of particles having a diameter of 0.5×D50 or less constitutes 20% by volume or less of all the particles and the amount of particles having a diameter of 2×D50 or more constitutes 2% by volume or less.

100 Parts by weight of the particles and 0.50 parts by weight of a hydrophobic silica fine powder (BET specific surface area 120 $m^2/g$) surface-treated with a silane coupling agent and with a dimethyl silicone oil were mixed together to prepare a negative friction charge toner YO-08.

Example 2

A toner MO-08 was prepared in the same manner as in Example 1 except that a commercially available unpurified organic magenta pigment (Toner Magenta E-02 [manufactured by Clariant (Japan) KK]: C.I. pigment red 122) was used in place of the unpurified organic yellow pigment.

Example 3

A toner CO-08 was prepared in the same manner as in Example 1 except that a commercially available unpurified organic cyan pigment (Hostaperm Blue B2G [manufactured by Clariant (Japan) KK]: C.I. pigment blue 15:3) was used in place of the unpurified organic yellow pigment.

Example 4

A toner YSO-08 was prepared in the same manner as in Example 1 except that the organic pigment scY purified with the supercritical fluid was used in place of the unpurified organic yellow pigment.

Example 5

A toner YSO-12 was prepared in the same manner as in Example 1 except that the organic pigment scY purified with the supercritical fluid was used in place of the unpurified organic yellow pigment and that C=12, C being the concentration of the organic pigment in the toner.

Example 6

A toner YSO-16 was prepared in the same manner as in Example 1 except that the organic pigment scY purified with the supercritical fluid was used in place of the unpurified organic yellow pigment and that C=16.

Example 7

A toner MSO-08 was prepared in the same manner as in Example 1 except that the organic pigment scM purified with the supercritical fluid was used in place of the unpurified organic yellow pigment.

Example 8

A toner MSO-12 was prepared in the same manner as in Example 1 except that the organic pigment scM purified with the supercritical fluid was used in place of the unpurified organic yellow pigment and that C=12.

Example 9

A toner MSO-16 was prepared in the same manner as in Example 1 except that the organic pigment scM purified with the supercritical fluid was used in place of the unpurified organic yellow pigment and that C=16.

Example 10

A toner CSO-08 was prepared in the same manner as in Example 1 except that the organic pigment scC purified with the supercritical fluid was used in place of the unpurified organic yellow pigment.

Example 11

A toner CSO-12 was prepared in the same manner as in Example 1 except that the organic pigment scC purified with the supercritical fluid was used in place of the unpurified organic yellow pigment and that C=12

Example 12

A toner CSO-16 was prepared in the same manner as in Example 1 except that the organic pigment scC purified with the supercritical fluid was used in place of the unpurified organic yellow pigment and that C=16.

Comparative Example 1

A toner Y2-08 was prepared in the same manner as in Example 1 with a master batch composition containing a commercially available unpurified organic yellow pigment (FAST YELLOW FGOK [manufactured by Sanyo Color Works, Ltd.]: C.I. pigment blue 74) was prepared and used and that a double-screw extruder PCM-35 (manufactured by Ikegai Tekkosha) was used in the kneading step.

Comparative Example 2

A toner M2-08 was prepared in the same manner as in Comparative Example 1 except that the organic yellow pigment was replaced with a commercially available unpurified organic magenta pigment (Toner Magenta E-02 [manufactured by Clariant (Japan) KK]: C.I. pigment red 122).

Comparative Example 3

A toner C2-08 was prepared in the same manner as in Comparative Example 1 except that the organic yellow pigment was replaced with a commercially available unpurified organic cyan pigment (Hostaperm Blue B2G [manufactured by Clariant (Japan) KK]: C.I. pigment blue 15:3).

Comparative Example 4

A toner YSC-08 was prepared in the same manner as in Comparative Example 1 except that the organic yellow pigment was replaced with the organic pigment scY purified with the supercritical fluid.

Comparative Example 5

A toner MSC-08 was prepared in the same manner as in Comparative Example 1 except that the organic yellow pigment was replaced with the organic pigment scM purified with the supercritical fluid.

Comparative Example 6

A toner CSC-08 was prepared in the same manner as in Comparative Example 1 except that the organic yellow pigment was replaced with the organic pigment scC purified with the supercritical fluid.

Properties (A) to (D) of the toners of Examples 1 to 12 and Comparative Examples 1 to 6 were evaluated in the manners below. The results are shown in Table 4. In Table 4, the numerals 1 to 4 represent a collective evaluation result of each toner. The numeral 4 indicates that the toner is the most desirable in practical use; the numeral 3 indicates that the toner is within the range of practical use; the numeral 2 indicates that the toner is somewhat inadequate in practical use; and the numeral 1 indicates that the toner is inadequate in practical use.

(A) Spectral Transmittance Curve (1−R/A)

Each toner was subjected to extraction that used the device shown in FIG. 2 under the following conditions to obtain an extracted liquid.

Extracting Conditions

Object to be purified: color toner 10 g
Extraction solvent: carbon dioxide 61 g
Hydrophilic cosolvent: methanol 120 g
Pressure: 25 atm
Temperature: 40° C.
Extraction tube capacity: 200 ml
Extraction time: 60 min.

The extracted liquid was subjected to spontaneous sedimentation for one day to obtain a supernatant fluid, and spectral transmittance of the supernatant fluid at a wavelength of 380 to 780 nm was measured using a spectrophotometer U-3300 (manufactured by Hitachi, Ltd.). The measured spectral transmittance can be shown graphically as in FIG. 1. In FIG. 1, as explained above, the symbol R represents an area expressed in white that is determined by the Rectangular method on the basis of a spectral transmittance curve, and the symbol R' represents an area expressed in solid-black. When all area in FIG. 1 is represented by the symbol A, the formula $R'/A=1-R/A$ holds. A spectral transmittance curve of the toner is evaluated according to $1-R/A$. It is desirable that $1-R/A \leqq 0.014C$, wherein C is the concentration of the organic pigment in the toner.

(B) Dispersion Particle Diameter of Organic Pigment

The particle diameter of the organic pigment when the organic pigment is present in each toner (dispersion particle diameter of each organic pigment) was determined by cutting a toner particle by a microtome to obtain a sample in the form of a flake; capturing a photograph of the sample under a magnification of 10000 times by means of a transmission electron microscope (TEM); measuring a major diameter and a minor diameter of a pigment portion of the sample by means of an image analyzer (OMNICON 3500: manufactured by SHIMADZU CORPORATION); determining an average value of the major diameter and minor diameter; and averaging average values of 1000 samples obtained in the above manner. It is desirable that an organic pigment has a dispersion particle diameter of 1/10 to 1/2 (when the organic pigment is an organic yellow pigment, 1/10 to 4/7) of a maximum absorption wavelength of the organic pigment. The organic pigments used in Examples and Comparative Examples have maximum absorption wavelengths: 414 nm (organic yellow pigments); 538 nm (organic magenta pigments); and 713 nm (organic cyan pigments).

(C) Particle Diameter of Toner

The particle diameter of each toner was measured as the volume-average particle diameter by a laser diffraction type particle diameter measuring apparatus SALD-2000A (manufactured by SHIMADZU CORPORATION).

(D) Transparency 1

Image samples were formed on an OHP sheet (IJ188OHP: manufactured by Sharp Document System) under development and fixing conditions controlled for optimizing chromaticity and chroma. Then, the haze of each toner on the image samples was measured using a haze meter (manufactured by Tokyo Denshoku Ltd). As the haze of a toner declines, the transparency thereof improves. A toner having a haze of 20 or less has a good transparency, and a toner having a haze of 15 or less has a significantly high transparency, while a toner having a haze of 25 or more is inadequate in practical use as a color toner. The transparency of each color toner was evaluated according to Table 1 below.

TABLE 1

| Transparency evaluation criterion | | | | |
|---|---|---|---|---|
| | Judgment | | | |
| | 1 (Poor) | 2 (Fair) | 3 (Good) | 4 (Excellent) |
| Haze | 25 or more | 20 or more to less than 25 | 15 or more to less than 20 | Less than 15 |

Next, the toners of Examples 1 to 12 and Comparative Examples 1 to 6 each were mixed with a silicon-coated ferrite core carrier having an average particle diameter of 60 μm, to produce two-component type developers containing the respective toners in a concentration of 5 wt %. Subsequently, images were developed on a full color sheet (PP106A4C: manufactured by Sharp Corporation) using the two-component type developers and a AR-C150 (manufactured by Sharp Corporation) while making control so that the respective toners adhered in the below-mentioned amount to the full color sheet, and then the images were fixed by an external fixing apparatus to prepare image samples. The image samples were evaluated on image properties (E) to (G) in the following manners. The results are shown in Table 4. Here, development and fixing conditions must be optimized according to the concentration of the organic color pigments of each color because, when images are developed using color toners of different colors each containing an organic color pigment in a concentration of 8 wt % or more with the same toner adhesion amount and fixed under the same fixing conditions, colors of some toners may change in chromaticity and degrade in chroma from corresponding basic process colors.

(E) Tinting Strength

The densities (ID values) of the images obtained when the respective toners adhered in an amount 0.80 mg/cm$^2$ to the full color sheet were measured by a density meter RD-918 (manufactured by Macbeth Co.), and the tinting strengths of the toners were evaluated according to Table 2. A toner used for formation of an image whose ID value is 1.5 or more is evaluated as ensuring good image quality at high concentration printing and a toner used for formation of an image whose ID value is 2.0 or more is evaluated as ensuring excellent image quality.

TABLE 2

| Tinting strength evaluation criterion | | | | |
|---|---|---|---|---|
| | Judgment | | | |
| | 1 (Poor) | 2 (Fair) | 3 (Good) | 4 (Excellent) |
| ID value | Less than 1.3 | 1.3 or more to less than 1.5 | 1.5 or more to less than 2.0 | 2.0 or more |

(F) Chroma

Image samples were prepared using the toners of Examples 1 to 12 and Comparative Examples 1 to 6 while controlling the amounts of the respective toners to adhere to the full color sheet and fixing conditions in order to ensure that colors of the respective toners are nearest in chromaticity to corresponding basic process colors and greatest chroma. Chroma of each toner was determined using a Spectrocolorimeter X-Rite (manufactured by Nippon Heiban Insatsu Kizai Ltd.) on the basis of the L*a*b* colorimetric system according to formula (II):

$$C^*=(a^{*2}+b^{*2})^{1/2} \quad \text{(II)},$$

wherein C* represents chroma, a* represents a red type level and a green type level; and b* represents a yellow type level and a blue type level.

The chroma of the toner of each color was evaluated according to Table 3 below.

TABLE 3

| Chroma evaluation criterion | | | | |
|---|---|---|---|---|
| | Judgment | | | |
| | 1 (Poor) | 2 (Fair) | 3 (Good) | 4 (Excellent) |
| Cyan | Less than 50 | 50 or more to less than 55 | 55 or more to less than 60 | 60 or more |
| Magenta | Less than 65 | 65 or more to less than 70 | 70 or more to less than 75 | 75 or more |
| Yellow | Less than 80 | 80 or more to less than 85 | 85 or more to less than 90 | 90 or more |

(G) Transparency 1

The haze of each toner was measured in the same manner as in evaluation (D). The transparency was measured according to Table 1.

TABLE 4

| | * | (C) | 1-R/A | (B) | (E) | (F) | (D) | (G) | Collective Evaluation |
|---|---|---|---|---|---|---|---|---|---|
| Ex. 1 (Yellow, Unpurified) | 8 | 6.9 | 0.11 | 221 | 1.9 | 91.2 | 15 | 16 | 3 |
| Ex. 2 (Magenta, Unpurified) | 8 | 6.4 | 0.10 | 258 | 2.0 | 77.8 | 14 | 15 | 3 |
| Ex. 3 (Cyan, Unpurified) | 8 | 5.8 | 0.08 | 295 | 2.1 | 68.5 | 15 | 16 | 3 |
| Ex. 4 (Yellow, Purified) | 8 | 6.4 | 0.10 | 208 | 2.0 | 93.1 | 11 | 12 | 4 |
| Ex. 5 (Yellow, Purified) | 12 | 6.1 | 0.16 | 219 | 2.3 | 92.0 | 12 | 13 | 4 |
| Ex. 6 (Yellow, Purified) | 16 | 5.8 | 0.20 | 231 | 2.4 | 90.2 | 13 | 14 | 4 |
| Ex. 7 (Magenta, Purified) | 8 | 6.3 | 0.11 | 231 | 2.2 | 78.3 | 11 | 12 | 4 |
| Ex. 8 (Magenta, Purified) | 12 | 5.9 | 0.16 | 245 | 2.4 | 77.5 | 13 | 14 | 4 |
| Ex. 9 (Magenta, Purified) | 16 | 5.7 | 0.21 | 263 | 2.5 | 75.7 | 13 | 14 | 4 |
| Ex. 10 (Cyan, Purified) | 8 | 6.4 | 0.09 | 252 | 2.1 | 69.8 | 10 | 11 | 4 |
| Ex. 11 (Cyan, Purified) | 12 | 5.9 | 0.14 | 299 | 2.5 | 69.0 | 12 | 13 | 4 |
| Ex. 12 (Cyan, Purified) | 16 | 5.8 | 0.19 | 325 | 2.6 | 68.1 | 12 | 13 | 4 |
| Comp. Ex. 1 (Yellow, Unpurified) | 8 | 6.4 | 0.12 | 445 | 1.4 | 81.7 | 25 | 26 | 1 |

TABLE 4-continued

| | * | (C) | 1-R/A | (B) | (E) | (F) | (D) | (G) | Collective Evaluation |
|---|---|---|---|---|---|---|---|---|---|
| Comp. Ex. 2 (Magenta, Unpurified) | 8 | 6.6 | 0.13 | 773 | 1.2 | 67.6 | 26 | 27 | 1 |
| Comp. Ex. 3 (Cyan, Unpurified) | 8 | 6.2 | 0.12 | 530 | 1.6 | 53.4 | 23 | 24 | 1 |
| Comp. Ex. 4 (Yellow, Purified) | 8 | 6.7 | 0.08 | 346 | 1.6 | 85.7 | 18 | 19 | 2 |
| Comp. Ex. 5 (Magenta, Purified) | 8 | 6.3 | 0.09 | 320 | 1.6 | 67.6 | 17 | 18 | 1 |
| Comp. Ex. 6 (Cyan, Purified) | 8 | 6.5 | 0.11 | 365 | 1.7 | 58.9 | 16 | 17 | 2 |

*: Organic pigment concentration (wt %)
(C): Toner Particle diameter D50 (i m)
(B): Organic pigment dispersion particle diameter (nm)
(E): Tinting strength
(F): Chroma
(D): Transparency 1 (haze)
(G): Transparency 2 (haze)

The toners of Examples 1 to 12 satisfy all the conditions: the formula (I): 1−R/A≦0.014C (I); that the organic pigment should have a dispersion particle diameter of 1/10 to 1/2 (200 to 330 nm) (when the organic pigment is an organic yellow pigment, 1/10 to 4/7) of its maximum absorption wavelength; and that the toner should have a haze of 16 or less. The toners of Examples 5 to 12 are excellent in tinting strength, chroma and transparency. Though the toners of Examples 1 to 3 are somewhat inferior in transparency, and the toner of Example 1 is somewhat inferior also in tinting strength, all the toners of Examples 1 to 12 are within the scope of practical use in collective evaluation. By comparison of Examples 5 to 12 with Examples 1 to 3, it is found that use of the purified organic pigments leads to improved toner properties.

In Comparative Examples 1 to 3, unlike Examples 1 to 12, the toners were prepared using the double-screw kneader and thus with no sufficient shear, so that the organic pigments in the toners have a great dispersion particle diameter. Also these toners do not have high scores in tinting strength, chroma and transparency, and especially, their scores in transparency are low. Especially, the organic pigment of the toner of Comparative Example 2, wherein a kneading temperature exceeded 120° C. and thus the resin had a decreased viscosity, which made it impossible to apply sufficient shear, has an extremely great dispersion particle diameter. The toners of Comparative Examples 4 to 6 were prepared using the purified organic pigments and the double-screw kneader, and satisfy the formula (I): 1−R/A≦0.014C, which is one of the above conditions. The organic pigments in these toners have greater dispersion particle diameters than those of the organic pigments in the toners of Examples 1 to 12 because of lack of sufficient shear. The toners of Comparative Examples 4 to 6 are inferior to the toners of Examples 1 to 12 especially in tinting strength and chroma. With respect to the toner of Comparative Example 5, the organic pigment has a dispersion particle diameter of 320 nm, and thus the toner satisfies one of the above conditions but has a haze exceeding 16, which indicates that the toner does not have sufficient transparency.

In Examples 1 to 12, the mixture of the binding resin and the organic pigment wherein the organic pigment is contained in an amount of 8 to 20 wt % is melted and kneaded, and the mixture is pulverized to prepare the toner wherein the organic pigment has a very small particle diameter of 200 to 300 nm. The toner thus obtained has a haze of 15 or less, excellent tinting strength, chroma and transparency and thus ensures formation of images bright in color. Especially when a purified organic pigment is used, the toner has improved properties.

The toner for electrostatic image development of the present invention can suitably be used for a copier or a printer.

What is claimed is:

1. A melt-mixed toner for electrostatic image development, comprising an organic pigment and a binding resin produced by melt-mixing, and satisfying the formula (I):

$$1-R/A \leqq 0.014C \quad \text{(I)},$$

wherein A represents an entire area of a graph (x-axis: wavelength of a visible radiation region (380 to 780 nm), y-axis: transmittance (0 to 100%)) showing a spectral transmittance curve of a supernatant fluid, the supernatant fluid being obtained by subjecting the toner to an extraction process, the extraction process using a supercritical fluid; R represents an area determined by a Rectangular method on the basis of a spectral transmittance curve in the graph; and C represents a concentration (wt %) of the organic pigment in the toner, the organic pigment having a dispersion particle diameter of 1/10 to 1/2 of a maximum absorption wavelength of the organic pigment, and the organic pigment having a dispersion particle diameter of 1/10 to 4/7 of a maximum absorption wavelength of the organic pigment when the organic pigment is a yellow pigment, and the toner having a haze of 16 or less;

wherein (A) the concentration of the organic pigment C in the toner is 8 wt % to 20 wt %, (B) a magenta pigment and a cyan pigment in the toner each have a dispersion particle diameter of 1/10 to 1/2 of a maximum absorption wavelength, (C) the formula (I) describes a level of impurities in the organic pigments which does not degrade chroma or transparency, (D) the particle diameter of magenta pigment, cyan pigment and yellow pigment, when present, all pigments of said toner to exhibit favorable transparency, and (E) the haze of said toner is sufficiently limited such that said toner exhibits favorable transparency.

2. The toner of claim 1, wherein the organic pigment is a pigment purified by an extraction process, the extraction process using a supercritical fluid.

3. The toner of claim 2, wherein the supercritical fluid is carbon dioxide.

4. A melt-mixed toner for electrostatic image development, comprising an organic pigment and a binding resin produced by melt-mixing, and satisfying the formula (I):

$$1-R/A \leqq 0.014C \quad \text{(I)},$$

wherein A represents an entire area of a graph (x-axis: wavelength of a visible radiation region (380 to 780 nm), y-axis: transmittance (0 to 100%)) showing a spectral transmittance curve of a supernatant fluid, the supernatant fluid being obtained by subjecting the toner to an extraction process, the extraction process using a supercritical fluid; R represents an area determined by a Rectangular method on the basis of a spectral transmittance curve in the graph; and C represents a concentration (wt % of the organic pigment in the toner, the organic pigment having a dispersion particle diameter of 200-330 nm, and the toner having a haze of 16 or less, wherein (A) the concentration of the organic pigment C in the toner is 8 wt % to 20 wt %, (B) the formula (I) describes a level of impurities in the organic pigments which does not degrade chroma or transparency, (C) the haze of said toner is sufficiently limited such that said toner exhibits favorable transparency, (D) the organic pigment is a magenta pigment, a cyan pigment and a yellow pigment, and (E) the particle diameter of 200-330 nm of the magenta pigment, the cyan pigment and the yellow pigment allow the pigments to exhibit favorable transparency.

5. The toner of claim 4, wherein the organic pigment is a pigment purified by an extraction process, the extraction process using a supercritical fluid.

6. The toner of claim 5, wherein the supercritical fluid is carbon dioxide.

7. A two-component developer comprising a toner of claim 1.

8. A two-component developer comprising a toner of claim 4.

* * * * *